US008093814B2

(12) United States Patent
Kim et al.

(10) Patent No.: US 8,093,814 B2
(45) Date of Patent: Jan. 10, 2012

(54) ELECTRODE-FORMING COMPOSITION AND PLASMA DISPLAY PANEL MANUFACTURED USING THE SAME

(75) Inventors: Chul-Hong Kim, Yongin-si (KR); Hyun-Mi Jeong, Yongin-si (KR)

(73) Assignee: Samsung SDI Co., Ltd. (KR)

( * ) Notice: Subject to any disclaimer, the term of this patent is extended or adjusted under 35 U.S.C. 154(b) by 720 days.

(21) Appl. No.: 11/748,809

(22) Filed: May 15, 2007

(65) Prior Publication Data

US 2008/0067938 A1 Mar. 20, 2008

(30) Foreign Application Priority Data

Sep. 15, 2006 (KR) ..... 10-2006-0089596

(51) Int. Cl.
*H01J 17/49* (2006.01)

(52) U.S. Cl. ..... 313/587; 313/582

(58) Field of Classification Search ..... 313/582–587; 345/37, 41, 60, 71

See application file for complete search history.

(56) References Cited

U.S. PATENT DOCUMENTS

| | | | | |
|---|---|---|---|---|
| 5,493,175 | A | 2/1996 | Kani | |
| 6,998,780 | B2 | 2/2006 | Matsumoto et al. | |
| 7,002,297 | B2 * | 2/2006 | Aoki et al. | 313/584 |
| 7,153,177 | B2 | 12/2006 | Uemura et al. | |
| 2002/0096666 | A1 | 7/2002 | Ichikawa et al. | |
| 2003/0108753 | A1 | 6/2003 | Fujii et al. | |
| 2004/0217708 | A1 | 11/2004 | Matsumoto et al. | |
| 2004/0232840 | A1 * | 11/2004 | Aoki et al. | 313/582 |
| 2005/0057176 | A1 | 3/2005 | Lu et al. | |
| 2005/0159070 | A1 * | 7/2005 | Banba et al. | 445/24 |
| 2005/0271979 | A1 | 12/2005 | Lee et al. | |
| 2006/0119265 | A1 | 6/2006 | Cho | |

FOREIGN PATENT DOCUMENTS

| | | |
|---|---|---|
| CN | 1360685 A | 7/2002 |
| JP | 8-31327 | 2/1996 |
| JP | 11-242930 | 9/1999 |

(Continued)

OTHER PUBLICATIONS

Office Action issued in corresponding European Patent Application No. 07115340.7 dated Feb. 13, 2009.

(Continued)

*Primary Examiner* — Nimeshkumar Patel
*Assistant Examiner* — Donald Raleigh
(74) *Attorney, Agent, or Firm* — Knobbe, Martens, Olson & Bear LLP

(57) ABSTRACT

An electrode-forming composition and a plasma display panel manufactured using the electrode-forming composition are provided. The electrode-forming composition includes: frit, a metal powder, and a vehicle, wherein the metal powder and the frit are contained in a weight ratio of 52 to 62:5 to 15; the plasma display panel including: first and second substrates that face each other with a predetermined distance between; a first electrode formed on the first substrate and extending in a first direction; a dielectric layer formed on the first substrate to cover the first electrode; a second electrode spaced apart from the first electrode, formed on the second substrate, and extending in a second direction crossing the first direction; a barrier rib in a space between the first substrate and the second substrate where the barrier rib defines a plurality of discharge cells; and a phosphor layer formed within each discharge cell, wherein the first electrode includes an insulating glass lager along an edge in the first direction.

22 Claims, 5 Drawing Sheets

FOREIGN PATENT DOCUMENTS

| | | | |
|---|---|---|---|
| JP | 2002-25451 | | 1/2002 |
| JP | 2004-127529 | | 4/2004 |
| JP | 3742009 | | 11/2005 |
| JP | 2005-352481 | | 12/2005 |
| JP | 2006-128055 | | 5/2006 |
| TW | 583707 | | 4/2004 |
| TW | 1224297 | | 11/2004 |
| TW | 2005/20618 | A | 6/2005 |
| WO | WO 00/33347 | A1 | 6/2000 |

OTHER PUBLICATIONS

Japanese Office Action dated Mar. 30, 2010, issued in corresponding Japanese Patent Application No. 2007-069023.
Office Action issued in corresponding European Patent Application No. 07115340.7 dated Jul. 15, 2009.
Office Action issued in Korean Patent Application No. 2006-89596 on Jul. 19, 2007.
TIPO Office Action & Search Report dated Dec. 27, 2010, 18 pages.

* cited by examiner

ELECTRODE-FORMING COMPOSITION AND PLASMA DISPLAY PANEL MANUFACTURED USING THE SAME

CROSS-REFERENCE TO RELATED APPLICATIONS

This application claims the benefit of Korean Application No. 2006-89596, filed Sep. 15, 2006, in the Korean Intellectual Property Office, the disclosure of which is incorporated herein by reference.

BACKGROUND OF THE INVENTION

1. Field of the Invention

Aspects of the present invention relate to an electrode-forming composition and a plasma display panel manufactured using the same, and more particularly, to an electrode-forming composition of which a composition ratio is optimized so as to protect an electrode against a migration effect and an edge-curl, as well as a plasma display panel manufactured using the same.

2. Description of the Related Art

As is well known, a plasma display panel (hereinafter referred to as "PDP") is a display device that forms an image by using visible light beams of red (R), green (G), and blue (B) generated when vacuum ultra-violet (VUV) rays, which are emitted from plasma obtained through a gas discharge, excite a phosphor material.

With the PDP, the thickness of a very large screen with a diagonal greater than 60 inches can be minimized to less than 10 cm. Since the PDP is a self-emissive device like a CRT, distortion does not take place in terms of color reproduction capability and viewing angle. Further, the manufacturing process of the PDP is simpler than that of a liquid crystal display (LCD). Therefore, the PDP, having merits of high productivity and cost competitiveness, is highly expected to be used for television sets and industrial flat displays.

The structure of the PDP has been in development since 1970. A currently well-known structure thereof is an AC three-electrode surface discharge structure.

A PDP employing the AC three-electrode surface discharge structure is generally constructed such that pairs of display electrodes are formed on a front substrate with their surfaces facing the front substrate, and address electrodes are formed on the rear substrate spaced apart from the front substrate. A barrier rib is disposed between the front and rear substrates to define a plurality of discharge cells. The discharge cells are formed along positions where the display electrodes cross the address electrodes. Phosphor layers are formed inside the discharge cells, and a discharge gas is injected therein. The injected discharge gas produces a discharge within the discharge cells according to a voltage supplied through the above-mentioned electrodes. Ultra-violet rays generated by the discharge collide against the phosphor layers inside the discharge cells, thereby generating visible light.

In the PDP employing this structure, a discharge cell to be turned on and a discharge cell not to be turned on are selected by using the memory characteristic of wall charges. The selected discharge cell is discharged to display an image.

A PDP having a 42-inch diagonal screen size with resolution of XGA (1024×768) has recently become available in the market. Ultimately, there is a demand for a display device capable of displaying a Full-HD (high definition) image. In order for a PDP to display a Full-HD (1920×1080) image, a discharge cell has to be reduced in size to achieve that higher density. Accordingly, the width and pitch of the electrodes need to be more densely formed.

In general, the PDP includes an address electrode formed of silver (Ag) having high electric conductivity and that is relatively inexpensive. However, when the width of the electrodes and the space between them (pitch) is narrower in order to achieve the desired higher density, the electrodes may become electrically open or a short circuit may occur due to a migration effect occurring at the edges of neighboring electrodes. The migration effect may arise from various causes. In many cases, it is caused by chemical or physical problems stemming from external air and/or temperature. The external air and/or temperature eventually promote diffusion of the photosensitive silver electrode generally used for an electrode. This may electrically open the circuit between discharge and address electrodes or short circuit the electrodes by forming a bridge between two neighboring electrodes.

Thus, various attempts are underway to prevent defects with silver electrodes caused by the migration effect.

For example, there is a method in which electrodes where the migration effect occurs are treated with various air-proof/moisture-proof materials, and organic/non-organic foreign materials between the electrodes are removed as much as possible through cleansing and the like. When an electronic device having semiconductors and other electrode wires is used, instead of the highly responsive material of silver, an extremely expensive metal (e.g. gold, platinum, etc.) is used. Alternatively, a full solid solution of palladium (Pd) or the like is added with silver.

When a PDP generally including a silver electrode is used, in order to reduce electrode manufacturing operations and material costs, characteristics of the electrode itself have to be controlled so as to prevent the migration effect.

An address electrode is formed such that a photosensitive silver paste is applied on a rear substrate and is then dried to form an electrode layer, and the electrode layer is exposed and developed in such a way as to form patterns on the electrode.

However, in the process of forming this address electrode, if exposure and development processes are not properly controlled, an edge-curl may take place whereby both edges of the address electrode are curled up (see FIG. 6(*a*)).

The edge-curl may cause concentration of the discharge voltage that is supplied to the address electrode, and damage in the dielectric layer that covers the edge-curl during a gas discharge. Accordingly, product reliability decreases.

SUMMARY OF THE INVENTION

Aspects of the present invention provide an electrode-forming composition where the composition ratio of the components is regulated to enhance product reliability by preventing a migration effect and an edge-curl occurring at an electrode.

Aspects of the present invention also provide a plasma display panel manufactured by using an electrode paste having the regulated composition ratio mentioned above.

According to an aspect of the present invention, there is provided an electrode-forming composition including frit, a metal powder, and a vehicle, wherein the metal powder and the frit are contained in a weight ratio of 52 to 62:5 to 15.

In the aforementioned aspect of the present invention, the frit may contain $B_2O_3$ and BaO, and the weight ratio of BaO to $B_2O_3$ may be equal to or greater than 1, or within a range of 1 to 5. The frit may be selected from the group consisting of $SiO_2$, PbO, $Bi_2O_3$, ZnO, $B_2O_3$, and BaO, and a combination thereof.

In addition, the metal powder may be selected from the group consisting of silver (Ag), gold (Au), aluminum (Al), copper (Cu), nickel (Ni), chromium (Cr), zinc (Zn), tin (Sn), an alloy of silver-palladium (Ag—Pd), and a combination thereof. Further, the metal powder may be a silver (Ag) powder.

The vehicle may include an organic solvent and a binder.

The organic solvent may be selected from the group consisting of ketones, alcohols, ether alcohols, saturated fatty mono carboxylic acid alkyl esters, lactic acid esters, ether esters, and a combination thereof.

The binder may be selected from a group consisting of an acrylic resin, a styrene resin, a novolak resin, a polyester resin, and a combination thereof.

According to another aspect of the present invention, there is provided a plasma display panel including: first and second substrates that face each other with a predetermined distance between; a first electrode formed on the first substrate and extending in a first direction; a dielectric layer formed on the first substrate to cover the first electrode; a second electrode spaced apart from the first electrode, formed on the second substrate, and extending in a second direction crossing the first direction; a barrier rib in the space between the first substrate and the second substrate where the barrier rib defines a plurality of discharge cells; and a phosphor layer formed within each discharge cell, wherein the first electrode contains the metal powder and the frit in a weight ratio of 52 to 62:5 to 15.

In the aforementioned aspect of the present invention, the frit may contain $B_2O_3$ and BaO, and the weight ratio of the BaO to $B_2O_3$ may be equal to or greater than 1. Further, the metal powder may be a silver (Ag) powder.

According to another aspect of the present invention, there is provided a plasma display panel including: first and second substrates that face each other with a predetermined distance between; a first electrode formed on the first substrate and extending in a first direction; a dielectric layer formed on the first substrate to cover the first electrode; a second electrode spaced apart from the first electrode, formed on the second substrate, and extending in a second direction crossing the first direction; a barrier rib in a space between the first substrate and the second substrate where the barrier rib defines a plurality of discharge cells; and a phosphor layer formed within each discharge cell, wherein the first electrode includes an insulating glass layer along an edge in the first direction.

In the aforementioned aspect of the present invention, the insulating glass layer may be formed in a long band shape along the edge of the first electrode. The insulating glass layer may be formed on each edge of the first electrode, the insulating glass layers being separated from each other.

In addition, the first electrode may include a metal layer, and the insulating glass layer may be formed in the same plane as the metal layer.

The insulating glass layer may be adjacent to the metal layer, and a surface of the insulating glass layer may be continuously inclined starting from an edge at the surface of the metal layer to the surface of the first substrate. The insulating glass layer may be formed to have an inclination so as to be curved.

The metal powder may be a silver (Ag) powder.

The first electrode may include a metal layer, and the metal layer and the insulating glass layer include frit of the same composition.

The first electrode may be supplied with an address voltage when driven.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
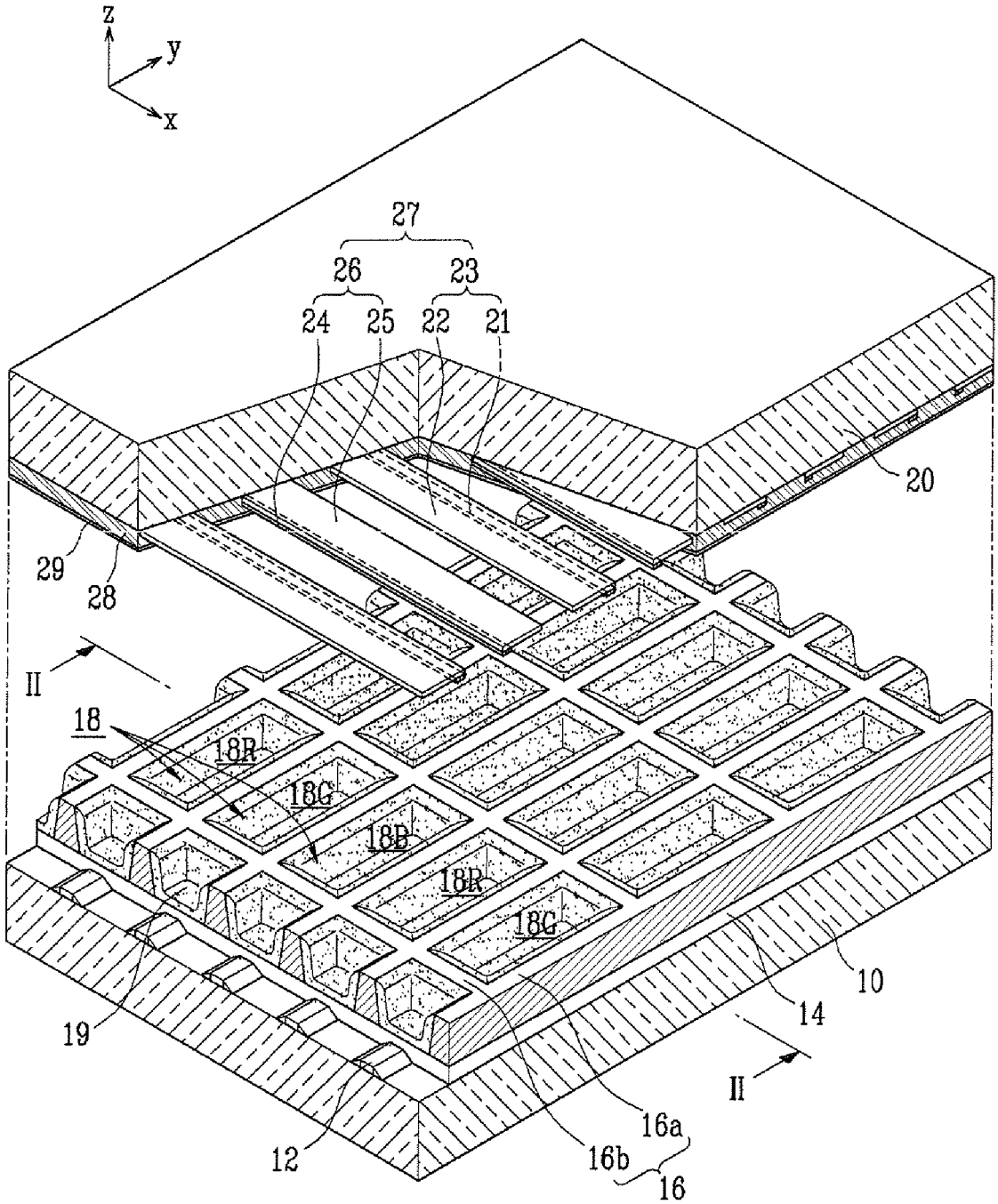
FIG. 1 is a perspective view of a plasma display panel according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

With reference to the accompanying drawings, embodiments of the present invention will be described in order for those skilled in the art to be able to implement it. As those skilled in the art would realize, the described embodiments may be modified in various different ways, all without departing from the spirit or scope of the present invention.

Figure 2:
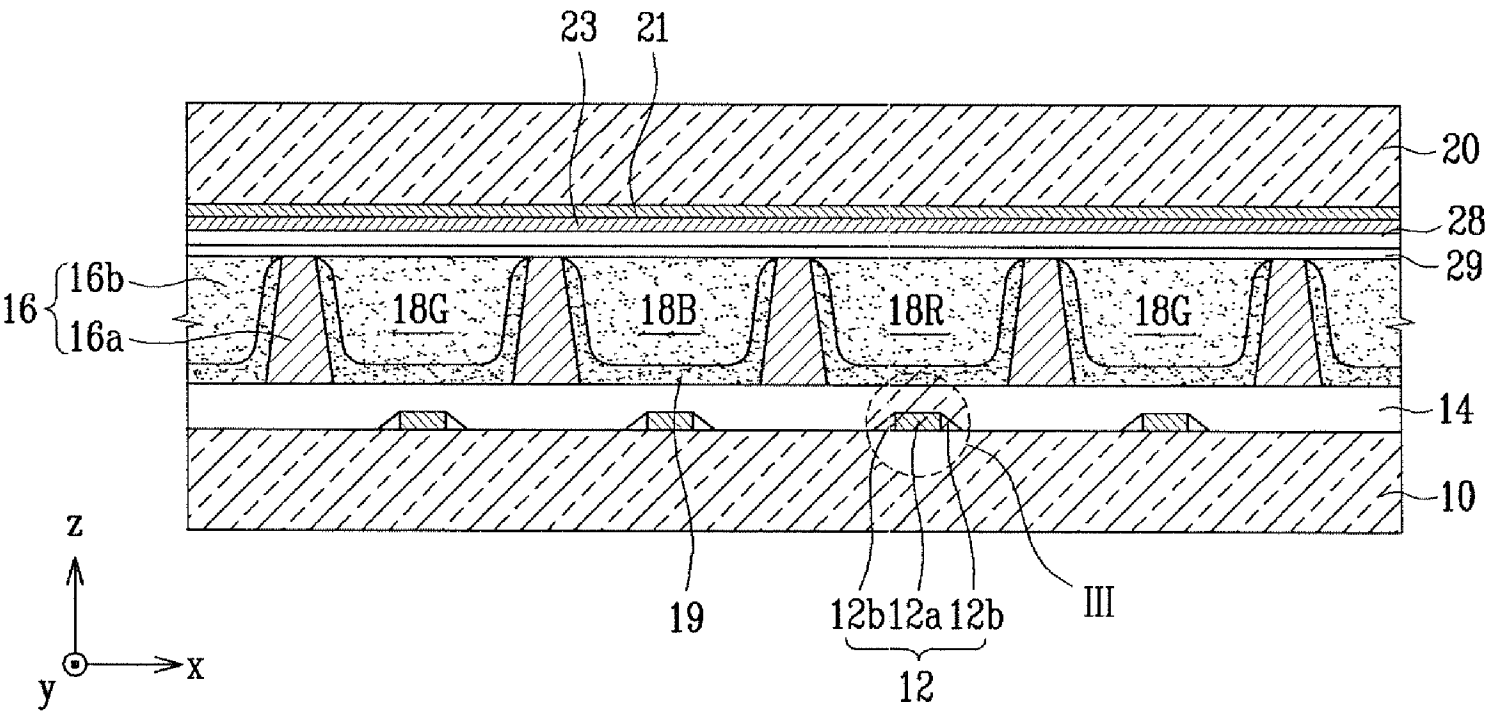
FIG. 2 is a lateral cross-sectional view taken along line II-II of FIG. 1.

FIG. 1 is a perspective view of a plasma display panel according to an embodiment of the present invention, and FIG. 2 is a lateral cross-sectional view taken along line II-II of FIG. 1.

Referring to FIG. 1, the plasma display panel according to the present embodiment includes a first substrate 10 (hereinafter referred to as "rear substrate") and a second substrate 20 (hereinafter referred to as "front substrate"). The two substrates 10 and 20 face each other with a predetermined distance between them. The edges of the rear substrate 10 and the front substrate 20 are sealed with frit (not shown), thereby forming a sealed discharge space between the substrates. In the discharge space formed by the rear substrate 10 and the front substrate 20, a plurality of discharge cells 18, defined by a barrier rib 16, are disposed between the rear substrate 10 and the front substrate 20.

In the present embodiment, the barrier rib 16 is formed independently from the rear substrate 10 in such a manner that a dielectric paste for the barrier rib 16 is applied on the rear substrate 10 and is then patterned and annealed.

The barrier rib 16 includes vertical barrier members **16*a* formed in a first, long, direction (y-axis direction in the drawing) and horizontal barrier members 16*b* formed in a second, short, direction (x-axis direction in the drawing) perpendicular to the vertical barrier members 16*a*. Accordingly, the discharge cells 18 are defined in a grid pattern by the vertical barrier members 16***a* and the horizontal barrier members 16*b*.

However, the plasma display panel of the present invention is not limited thereto. Thus, besides the aforementioned grid pattern, the discharge cells 18 may be defined in further various patterns such as a linear and parallel pattern or a delta pattern.

Referring now to FIG. 2, the address electrodes 12 are formed on the rear substrate 10. The address electrodes 12 correspond to the discharge cells 18 and extend in the first direction in a parallel manner.

Each address electrode 12 includes a metal layer 12*a* and an insulating glass layer 12*b*. The insulating glass layer 12*b* is adjacent to both edges of the metal layer 12*a* and is formed on the same plane thereof. The address electrodes 12 will be described below in greater detail with reference to FIGS. 3 and 4.

A dielectric layer 14 (hereinafter referred to as "lower dielectric layer") is formed on the rear substrate 10 to cover the address electrodes 12. As described above, the barrier rib 16, which is disposed between the rear substrate 10 and the front substrate 20 to define the discharge cells 18, is formed on the lower dielectric layer 14.

Inside each discharge cell 18, phosphor layers 19 are formed on the lateral sides of the barrier rib 16 and on the lower dielectric layer 14. Inside the discharge cells 18 defined in the first direction, the phosphor layers 19 are formed of the same color phosphor material. Inside the discharge cells 18 defined in the second direction, the phosphor layers 19 are repeatedly formed of the phosphor materials of red (18R), green (18G), and blue (18B).

Now, referring back to FIG. 1 as well as FIG. 2, display electrodes 27 are formed on the front substrate 20. The display electrodes 27 correspond to the discharge cells 18 and extend in the second direction crossing the first direction. The display electrodes 27 are formed such that scan electrodes 23 and sustain electrodes 26, both of which correspond to the discharge cells 18, are included in pairs.

The scan electrodes 23 and the sustain electrodes 26 respectively include bus electrodes 21 and 24 extending along the horizontal barrier member 16*b*. Further, the scan electrodes 23 and the sustain electrodes 26 respectively include transparent electrodes 22 and 25 extending by a width in the second direction from the bus electrodes 21 and 24 towards the centers of the discharge cells 18.

The transparent electrodes 22 and 25 are formed on the front substrate 20 and extend in a linear and parallel orientation in the second direction so that the transparent electrodes 22 and 25 correspond to the discharge cells 18. In order to enhance transmissivity of visible light, the transparent electrodes 22 and 25 are formed of transparent ITO (indium-tin oxide).

However, the display electrodes 27 of the present invention are not limited to the aforementioned structure. Thus, the transparent electrodes 22 and 25 may correspond to discharge cells 18R, 18G, and 18B of red (R), green (G), and blue (B) and respectively protrude from the bus electrodes 21 and 24.

In order to compensate for a voltage drop caused by the transparent electrodes 22 and 25, the bus electrodes 21 and 24 are formed of a metal material having excellent electric conductivity. The bus electrodes 21 and 24 may be further adjacent to the lateral horizontal barrier members 16*b* between which one of the discharge cells 18 is interposed, in order to increase the transmissivity of visible light generated inside the discharge cells 18 due to a plasma discharge. The bus electrodes 21 and 24 may be disposed above the horizontal barrier members 16*b*.

A dielectric layer 28 (hereinafter referred to as "upper dielectric layer") is formed to cover the scan electrodes 23 and the sustain electrodes 26.

A passivation layer 29 is formed on the upper dielectric layer 28 to avoid damage from exposure to the plasma discharge occurring within the discharge cells 18. The passivation layer 29 may be formed of an MgO layer that can transmit visible light. The MgO layer protects the upper dielectric layer 28. Since the MgO layer has a high secondary electron emission coefficient, the discharge ignition voltage can be further lowered.

A discharge gas (e.g., a mixture gas containing xenon (Xe), neon (Ne), etc.) is filled inside the discharge cells 18 where the phosphor layers 19 of R, G, and B are formed to produce a plasma discharge.

According to the present embodiment, when the plasma display panel is driven, a reset discharge occurs in response to a reset pulse supplied to the scan electrodes 23 during a reset period. During a scan period following the reset period, an address discharge occurs in response to a scan pulse supplied to the scan electrodes 23 and an address pulse supplied to the address electrodes 12. Thereafter, during a sustain period, a sustain discharge occurs in response to a sustain pulse supplied to the sustain electrodes 26 and the scan electrodes 23.

The sustain electrodes 26 and the scan electrodes 23 serve as electrodes for supplying the sustain pulse required for the sustain discharge. The scan electrodes 23 serve as electrodes for supplying the reset pulse and the scan pulse. The address electrodes 12 serve as electrodes for supplying the address pulse. However, the sustain electrodes 26, the scan electrodes 23, and the address electrodes 12 may have different roles according to the waveforms of the voltages supplied thereto, and thus the present invention is not limited to the aforementioned roles of the electrodes.

Accordingly, an image is formed by selecting the discharge cells 18 to be turned on by an address discharge produced in response to an interaction between the address electrodes 12 and the scan electrodes 23. Thereafter, the selected discharge cells 18 are driven by a sustain discharge produced in response to an interaction between the sustain electrodes 26 and the scan electrodes 23.

The structure of an address electrode of the plasma display panel of the present embodiment will now be described in greater detail with reference to FIGS. 3 and 4.

Figure 3:
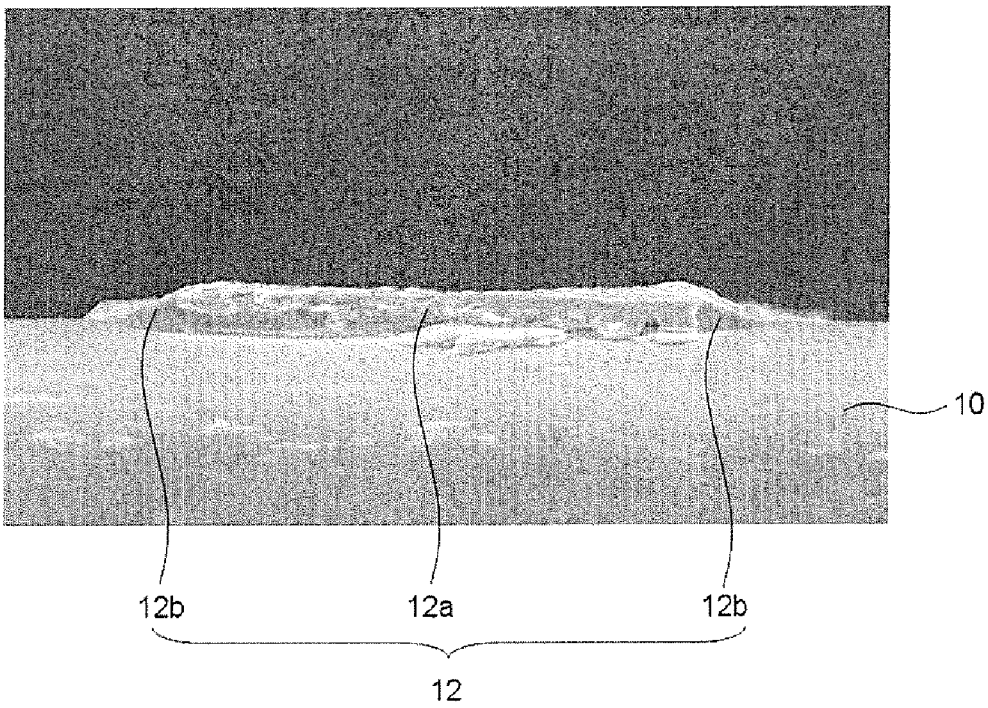
FIG. 3 is an enlarged photograph showing portion III of FIG. 2.
Figure 4:
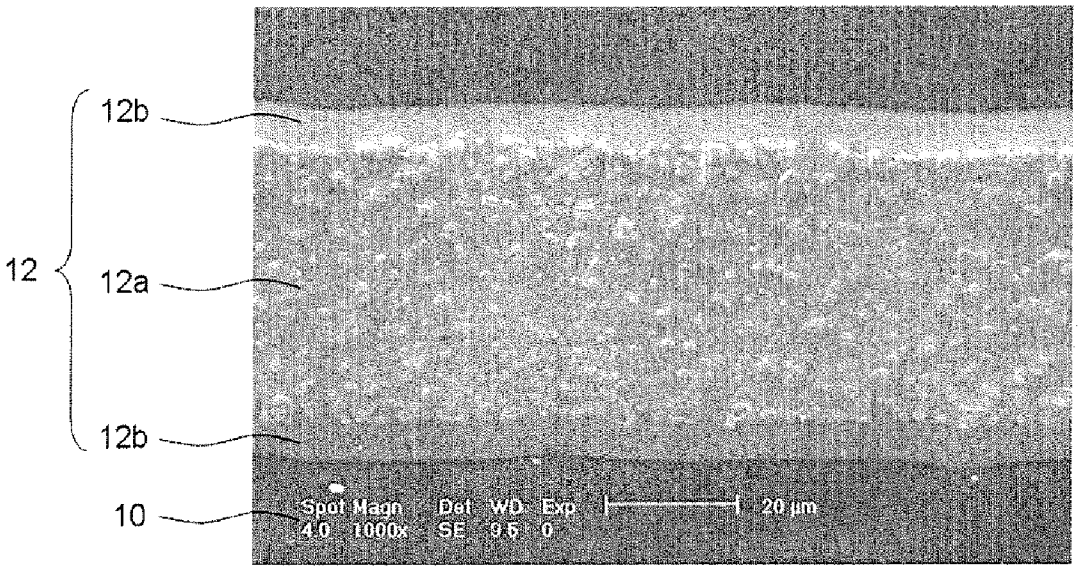
FIG. 4 is an enlarged photograph showing the planar shape of an address electrode of FIG. 3.

FIG. 3 is an enlarged photograph showing portion III of FIG. 2, and FIG. 4 is an enlarged photograph showing the planar shape of an address electrode of FIG. 3.

Referring to FIGS. 3 and 4, an address electrode 12 includes a metal layer 12*a* and an insulating glass layer 12*b*. The insulating glass layer 12*b* is adjacent to both edges of the metal layer 12*a* and is formed on the same plane thereof. The metal layer 12*a* is formed on a rear substrate 10 and extends in the first direction. The metal layer 12*a* forms an electrical conductive layer for supplying an address voltage to each discharge cell 18.

The metal layer 12*a* may be formed of a material (e.g. silver (Ag)) having high electric conductivity and that is relatively inexpensive. The metal layer 12*a* is generally formed from a silver powder originally in a paste state. When subjected to a firing process from the paste state, the silver powder is solidified with frit, thereby maintaining the shape of an electrode.

The insulating glass layer 12*b* has a band shape in the first direction along both edges of the metal layer 12*a* on the same plane as the metal layer 12*a*. The surface (upper surface) of the insulating glass layer 12*b* is continuously inclined starting from an edge at the surface of the metal layer 12*a* to the surface of the rear substrate 10. The surface of the insulating glass layer 12*b* may be formed to have a gentle inclination so as to be curved, with the inclination such that the narrowest portion of the insulating glass layer 12*b* is at the top of the metal layer 12*a* and the widest portion is on the rear substrate 10.

As a result, the insulating glass layer 12*b* is formed on the rear substrate 10 to cover the address electrode 12, and forms an insulation layer at both edges of the metal layer 12*a*, the insulating glass layer 12*b* being distinguishable from the lower dielectric layer 14.

The insulating glass layer 12*b* is composed of frit that has the same component as the frit included in the metal layer 12*a*. The frit may be formed to have the same composition ratio. That is, the metal layer 12*a* is formed when its major component of metal powder is solidified with frit. The major component of the insulating glass layer 12*b* is frit and frit is integrated into the metal layer 12*a* as well. However, the insulating glass layer 12*b* is formed separately from the metal layer 12*a*.

The address electrode 12 contains a metal powder and a frit in a weight ratio of 52 to 62:5 to 15.

If the weight ratio of the frit exceeds 15 or the weight ratio of the metal powder is less than 52, the electrical conductivity of the material is not sufficient, which leads to a decrease in electrical conductivity of the electrode. If the weight ratio of the frit is less than 5, or the weight ratio of the metal powder exceeds 62, it becomes difficult to form an insulating glass layer along an edge of the electrode, which causes problems such as edge curl, a migration effect, etc.

The frit contains $B_2O_3$ and BaO, and the weight ratio of BaO to $B_2O_3$ is equal to or greater than 1, or in the range of 1 to 5. The frit is mixed with the metal powder so as to facilitate bonding of the metal particles. If the weight ratio of BaO to $B_2O_3$ is less than 1, the glass transition temperature increases to affect liquid-state sintering, while a weight ratio exceeding 5 results in low electrical conductivity. Besides the aforementioned components, the frit may contain $SiO_2$, PbO, $Bi_2O_3$, and ZnO.

As described above, in the address electrode 12 of the present embodiment, since the insulating glass layer 12*b* insulates both edges of the metal layer 12*a*, it is possible to prevent open circuits or short circuits that may occur when a migration effect takes place between adjacent electrodes.

When the width of the address electrode generally formed of silver and the distance between adjacent electrodes (pitch) is reduced, the address electrodes can be more densely disposed to correspond with discharge cells having small pitches, thereby achieving higher density in a plasma display panel.

The aforementioned structure of the address electrode may be obtained by using a composition ratio appropriate for an electrode-forming composition and a manufacturing process thereof.

The process of forming an address electrode of the present embodiment will now be described with reference to FIG. 5.

Figure 5:
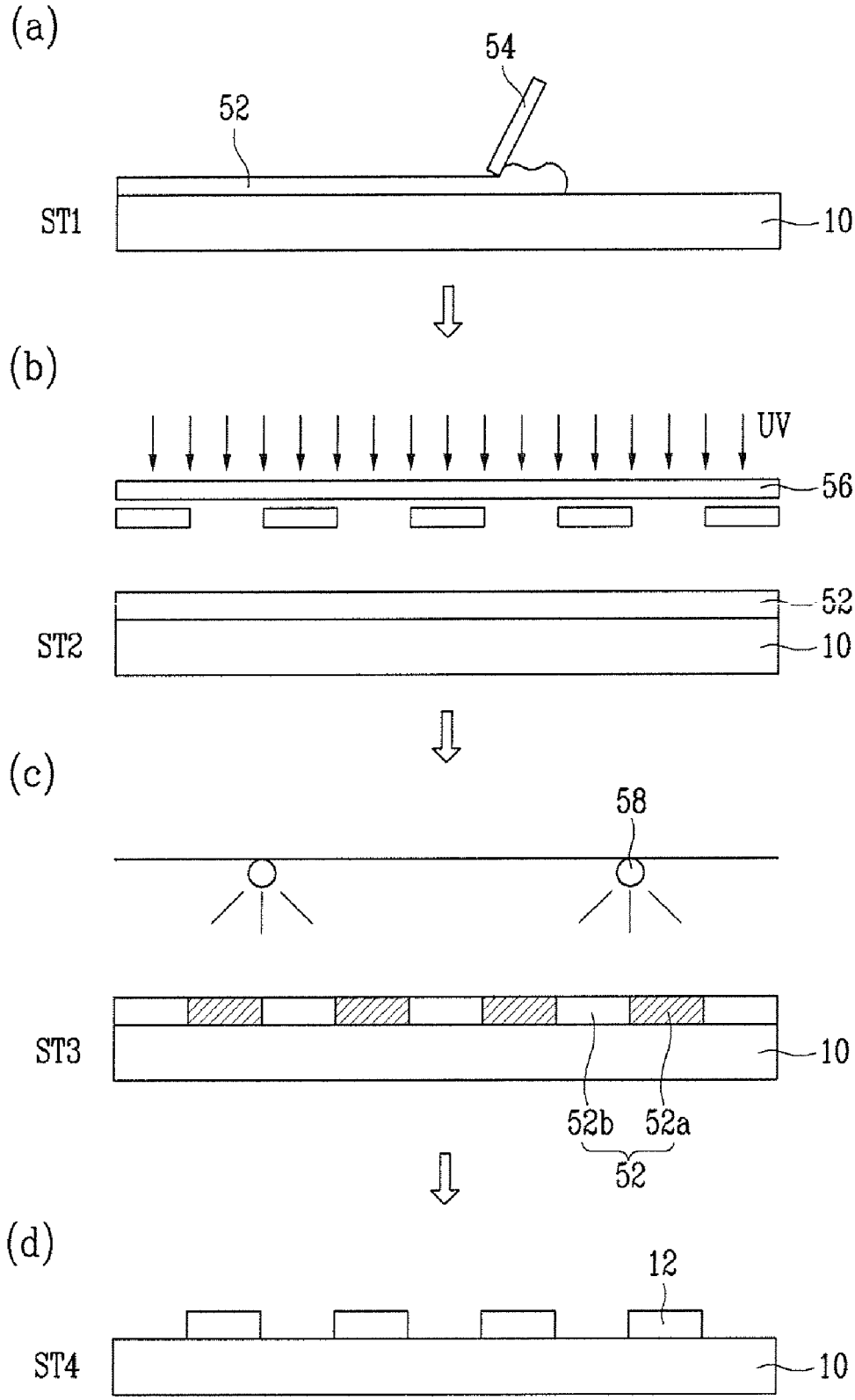
FIG. 5 is a schematic view showing a process of forming an address electrode of the present embodiment.

FIG. 5 is a schematic view showing the process of forming an address electrode of the present embodiment.

Referring to FIG. 5, the process of forming the address electrode of the present embodiment includes operations of forming an electrode layer (operation ST1), exposing/developing the electrode layer (operations ST2 and ST3), and firing the electrode layer (operation ST4).

In the operation of forming the electrode layer (operation ST1), as shown in FIG. 5(*a*), an electrode-forming composition in a paste state is applied on the rear substrate 10 by using a squeegee 54. This is thereafter dried to form an electrode layer 52. The electrode-forming composition can also be printed on the substrate by a screen-printing method (not shown) and then dried.

In the present embodiment, the electrode-forming composition includes a metal powder, frit, and a vehicle. The metal powder and the frit may be contained in a weight ratio of 52 to 62: to 5 to 15.

If the weight ratio of the metal powder is less than 52, or the weight ratio of the frit exceeds 15, electrical conductivity of the material is not sufficient, which leads to a decrease in electrical conductivity of the electrode. If the weight ratio of the metal powder exceeds 62, or the weight ratio of the frit is less than 5, it becomes difficult to form an insulating glass layer along an edge of the electrode, which causes problems such as edge curl, a migration effect, etc.

In general, the metal powder is formed of an electrically conductive metal material forming the metal layer 12*a*. Any metal material generally used in the address electrode and the bus electrode may be used without particular restriction. Specifically, the metal powder may be selected from the group consisting of silver (Ag), gold (Au), aluminum (Al), copper (Cu), nickel (Ni), chromium (Cr), zinc (Zn), tin (Sn), an alloy of silver-palladium (Ag—Pd), and combinations thereof. When the firing process is performed in the air, silver (Ag) may be used because the electrical conductivity of silver is not reduced by air oxidation, and silver is relatively inexpensive.

The metal powder may have various shapes such as a granular shape, a spherical shape, or a flake shape. In addition, the metal powder may have one of these shapes alone or another shape in which two or more shapes thereof are combined. When optical and dispersion characteristics are taken into account, the metal powder should have the spherical shape.

When the frit is subjected to the firing process, the metal powder is solidified to form an electrode shape. The insulating glass layer 12*b* is formed at the edges of the electrode.

The frit provides an adhesive force between the metal powder and a substrate during the firing process. The frit may contain $SiO_2$, PbO, $Bi_2O_3$, ZnO, $B_2O_3$, and BaO.

In order to decrease the glass transition temperature, the weight ratio of BaO to $B_2O_3$ has to be greater than 1. This weight ratio may be in the range of 1 to 5. If the weight ratio of BaO to $B_2O_3$ is less than 1, the glass transition temperature increases to affect liquid phase sintering, and a weight ratio exceeding 5 results in low electrical conductivity.

The vehicle includes an organic solvent and a binder.

The organic solvent may be any one of organic solvents typically used in the art. Specifically, ketones (e.g. diethyl ketone, methyl butyl ketone, dipropyl ketone, cyclohexanone, etc.); alcohols (e.g. n-pentanol, 4-methyl-2-pentanol, cyclohexanol, diacetone alcohol, etc.); ether alcohols (e.g. ethylene glycol monomethyl ether, ethylene glycol monoethyl ether, ethylene glycol monobutyl ether, propylene glycol monomethyl ether, propylene glycol monoethyl ether, etc.); saturated fatty monocarboxylic acid alkyl esters (e.g. n-butyl acetate, amyl acetate, etc.); lactic acid esters (e.g. ethyl lactate, n-butyl lactate, etc.); and ether esters (e.g., 2-methoxyethyl acetate, 2-ethoxyethyl acetate, propylene glycol monomethyl ether acetate, ethyl-3-epoxy propionate, 2,2,4-trimethyl-1,3-pentanediol mono(2-methylpropanoate), etc.). Any one of these organic solvents may be used alone or a combination of two or more thereof.

As the binder, a polymer that can be cross-linked by the use of a photo-initiator and is easily removed in the development process when an electrode is formed, may be used. Specifically, the binder may be selected from the group consisting of an acrylic resin, a styrene resin, a novolak resin, and a polyester resin, each of which is typically used when a photoresist is formed. Alternatively, the binder may be one or more copolymers selected from a group consisting of a monomer (i), a monomer (ii), and a monomer (iii) listed below.

Monomer (i): Monomers Containing a Carboxyl Group

Examples of monomers containing a carboxyl group include acrylic acid, methacrylic acid, maleic acid, fumaric acid, crotonic acid, itaconic acid, citraconic acid, mesaconic acid, cinnamic acid, mono(2-(meth)acryloyloxyethyl)succinate or ω-carboxy-polycaprolactone-mono(meth)acrylate.

Monomer (ii): Monomers Containing an OH Group

Examples of monomers containing an OH group include: aliphatic OH group monomers (e.g., 2-hydroxyethyl methacrylate, 2-hydroxypropyl methacrylate, 3-hydroxypropyl methacrylate, etc); and monomers containing a phenolic OH group (e.g. o-hydroxystyrene, m-hydroxystyrene, p-hydroxystyrene, etc.).

Examples of other copolymerizable monomers include: methacrylic acid esters except for the monomer (i) (e.g. methyl methacrylate, ethyl methacrylate, n-butyl methacrylate, n-lauryl methacrylate, benzyl methacrylate, glycidyl methacrylate, dicyclopentanyl(meth)acrylate, etc.); aromatic vinyl monomers (e.g. styrene, α-methylstyrene, etc.); conjugated dienes (e.g. 1,3-butadiene, isoprene, etc.); and micro polymers having a polymerizable unsaturated group in the acid portion of the monomer (e.g. polystyrene, poly(methylmethacrylate), poly(ethylmethacrylate), poly(benzylmethacrylate), etc.).

When an electrode-forming composition is applied on a substrate so as to form the metal layer 12*a*, the binder should have an appropriate viscosity. In consideration of decomposition in the development process to be described below, the binder should have an average molecular weight in the range of 5000 to 50,000 and an acid value of 20 to 100 mg KOH/g. If the average molecular weight of the binder is less than 5000, it may affect the adhesiveness of the metal layer in the development process. An average molecular weight thereof exceeding 50,000 is not desirable since poor development is likely to occur. If the acid value is less than 20 mg KOH/g, the solubility against an alkaline aqueous solution is not sufficient, which is likely to result in poor development. An acid value exceeding 100 mg KOH/g is not desirable since it lowers the adhesiveness of the metal layer, or an exposed portion is dissolved during the development process.

The content of the organic solvent and the content of the binder may be properly controlled to attain a suitable viscosity of the electrode-forming composition for the application process.

The electrode-forming composition according to the present invention may further include a cross-linking agent and a photo-initiator.

The cross-linking agent is not particularly limited as long as it is a compound that is reactive to a radical polymerization reaction by the use of the photo-initiator. Specifically, the cross-linking agent may be a multifunctional monomer. Alternatively, one or more cross-linking agents may be selected from the group consisting of ethylene glycol diacrylate, ethylene glycol dimethacrylate, trimethylolpropane triacrylate, trimethylolpropane trimethacrylate, tetramethylolpropane tetraacrylate, pentaerythritol tetraacrylate, and tetramethylolpropane tetramethacrylate.

The cross-linking agent may be added in proportion to the content of the binder. Alternatively, 20 to 150 parts by weight of the cross-linking agent may be added for 100 parts by weight of the binder. If the content of the cross-linking agent is less than 20 parts by weight, exposure sensitivity in the exposure process decreases while an electrode is formed, and a defect may occur in an electrode pattern in the development process. On the contrary, if the content thereof exceeds 150 parts by weight, a line width increases after development, and thus the pattern is not clearly formed in the process of forming the electrode pattern. As a result, after firing, residuals may be produced around the electrode. For these reasons, the cross-linking agent may be used within the aforementioned content range.

The photo-initiator generates a radical during the exposure process. The material forming the photo-initiator is not particularly limited as long as it is a compound capable of initiating a cross-linking reaction of the cross-linking agent. Specifically, one or more photo-initiators may be selected from a group consisting of methyl-2-benzoylbenzoate, 4,4'-bis(dimethylamine)benzophenone, 2,2-diethoxyacetophenone, 2,2-dimethoxy-2-phenylacetophenone, 2-methyl-[4-(methylthio)phenyl]-2-morpholinopropionaldehyde, 2-benzyl-2-dimethylamino-1-(4-morpholinophenyl)butyraldehyde, 2,4-diethylthioxanthone, and (2,6-dimethoxydibenzoyl)-2,4,4-pentylphosphineoxide.

The photo-initiator may be added in proportion to the content of the cross-linking agent. Preferably, the photo-initiator may be added at 10 to 50 parts by weight with respect to 100 parts by weight of the cross-linking agent. In this case, if the content of the photo-initiator is less than 10 parts by weight, the exposure sensitivity of the electrode-forming composition deteriorates. If the content thereof exceeds 50 parts by weight, the line width of the exposure portion is reduced, or a non-exposure portion is not developed. Therefore, it is not possible to obtain a clear electrode pattern.

In addition to the aforementioned components, the electrode-forming composition according to the present invention may further include an additive agent if required.

Examples of the additive agent include: a sensitizer that improves sensitivity; a polymerization inhibitor and anti-oxidant that improves the preservation of the electrode-forming composition; an ultraviolet (UV) absorber that improves resolution; a defoamer that reduces foam contained in the paste; a dispersant that improves dispersibility; a leveling agent that improves the flatness of the layers during printing; and a plasticizer that provides a thixotropic characteristic.

The use of these additive agents is not mandatory but is optional. When added, the quantities of the additive agents are adjusted as necessary to meet the required quality of the composition.

In the exposure process (operation ST2), as shown in FIG. 5(*b*), a mask 56 having an address electrode pattern is placed on the electrode layer 52, and the combination is irradiated with ultraviolet radiation (UV).

In the development process (operation ST3), as shown in FIG. 5(*c*), a development solution is dispersed through a nozzle 58. The unexposed portion 52*b* is etched and dried, leaving unchanged that exposure portion 52*a* that had been irradiated with UV rays in the exposure operation (operation ST2).

In the firing process (operation ST4), as shown in FIG. 5(*d*), the electrode portion remaining in the electrode layer is annealed, thereby forming the address electrode 12.

Through the firing process (operation ST4), the vehicle that is composed of the organic solvent, the binder, and the other additives in the electrode-forming composition is removed. Metal powder and frit remain therein.

Thus, the address electrode 12 includes the remaining metal powder and frit. The metal powder is solidified by the frit, thereby forming the metal layer 12*a* at the center of the address electrode 12. The frit forms the insulating glass layer 12*b* at both of the edges of the metal layer 12*a* (see FIGS. 3 and 4).

The above mechanism, in which the frit is formed at the edges of the metal layer 12*a* in the firing process (operation ST4) while forming the insulating glass layer 12*b*, may be considered as liquid-state sintering of typical ceramics.

In the first operation of the liquid-state sintering, that is, particle relocation, silver insulating glass layer 12*b* becomes a major drive force. After a neck is formed between the silver powder particles, the frit escapes to the outside of the silver powder particle-neck-silver powder particle combination.

When the glass frit escapes to the surface of the metal layer 12*a*, the number of open pores where only the silver powder particles can be present are significantly reduced.

The glass frit escapes partly to both ends of the metal layer 12*a*, and the insulating glass layer 12*b* continuously formed starting from an edge at the surface of the metal layer 12*a* to the surface of the rear substrate 10 is formed. In this case, referring to (b) of FIG. 6, the insulating glass layer 12*b* may be formed to have a gentle curved slope with the widest part of the layer along the rear substrate 10.

The insulating glass layer 12*b* insulates both ends of the metal layer 12*a* so that the migration effect occurring between adjacent address electrodes 12 can be prevented.

Further, in the firing process (operation ST4), the insulating glass layer 12*b* evens out the differences of the compression load between the edges and the center of the metal layer 12*a*. Therefore, edge-curl whereby both edges of the metal layer 12*a* are curled up can also be prevented.

Now, experimental embodiments and comparison examples for the electrode-forming composition according to aspects of the present invention will be described. The experimental examples described below are only exemplary, and thus the present invention is not limited thereto.

EXPERIMENTAL EXAMPLE 1

150 g of frit material, which contained $SiO_2$, PbO, $Bi_2O_3$, ZnO, $B_2O_3$, and BaO and wherein the weight ratio of BaO to $B_2O_3$ was 1,520 g of silver (Ag) powder, 50 g of a binder combining a methyl-methacrylate/methacrylic acid (MMA/MAA) copolymer, hydroxypropyl cellulose (HPC), ethyl cellulose (EC), and poly(isobutyl methacrylate) (PIBMA), 15 g of a photo-initiator that was 2,2-dimethoxy-2-phenyl acetophenone, and 10 g of a cross-linking agent that was tetramethylolpropane-tetraacrylate were added to 255 ml of 2,2,4-trimethyl-1,3-pentanediol monoisobutyrate (for example, TEXANOL® available from Eastman Chemical Corp.) and then were mixed in an agitator. Subsequently, a 3-roll mill was used to further promote agitation and dispersion. Thereafter, filtering and defoaming were performed. At this point, the electrode-forming composition was completely manufactured.

In the electrode-forming composition manufactured as described above, the metal powder and the frit were contained in a weight ratio of 52:15.

Next, a prepared glass substrate (10 cm×10 cm) was cleaned and dried. Thereafter, the electrode-forming composition manufactured as described above was printed on the glass substrate by using a screen printing method. Then, the combination was dried in a dry oven at 100° C. for 15 minutes to form a photosensitive conductive layer. A photo-mask, on which a striped pattern was formed, was disposed on the photo-sensitive conductive layer with a predetermined distance between them. Then, the masked combination was irradiated by UV rays of 450 mJ/cm$^2$ from a high pressure mercury lamp. The irradiated combination was now washed by a 0.4 weight % sodium carbonate aqueous solution at 35° C. for 25 seconds wherein the sodium carbonate solution was introduced through a nozzle with a dispersion pressure of 1.5 kgf/cm$^2$. The unexposed portion was then removed, thereby forming the desired electrode pattern.

Subsequently, firing was performed for 15 minutes at 580° C. by using an electric firing furnace, thereby forming an electrode with a pattern having a layer depth of 4 μm.

An anisotropic conductive film (ACF) and a tape carrier package (TCP) were then placed on the patterned electrode. Pre-compression and main-compression were performed thereon to achieve bonding, thereby manufacturing a plasma display panel.

EXPERIMENTAL EXAMPLE 2

A plasma display panel was manufactured in the same manner as in Experimental Example 1 except that 50 g of frit, which contained $SiO_2$, PbO, $Bi_2O_3$, ZnO, $B_2O_3$, and BaO and wherein the weight ratio of BaO to $B_2O_3$ was 1,620 g of a silver (Ag) powder, 55 g of a binder combining a methyl-methacrylate/methacrylic acid (MMA/MAA) copolymer, hydroxypropyl cellulose (HPC), ethyl cellulose (EC), and poly(isobutyl methacrylate) (PIBMA), 15 g of a photo-initiator that was 2,2-dimethoxy-2-phenyl-acetophenone, and 10 g of a cross-linking agent that was tetramethylolpropane-tetraacrylate were added to 240 ml of 2,2,4-trimethyl-1,3-pentanediol monoisobutyrate and then were mixed in an agitator.

The electrode-forming composition manufactured in Experimental Example 2 contained the metal powder and the frit in a weight ratio of 62:5.

EXPERIMENTAL EXAMPLE 3

A plasma display panel was manufactured in the same manner as in Experimental Example 1 except that 100 g of frit, which contained $SiO_2$, PbO, $Bi_2O_3$, ZnO, $B_2O_3$, and BaO and wherein the weight ratio of BaO to $B_2O_3$ was 1,580 g of a silver (Ag) powder, 56 g of a binder combining methyl-methacrylate/methacrylic acid (MMA/MAA) copolymer, hydroxypropyl cellulose (HPC), ethyl cellulose (EC), and poly(isobutyl methacrylate) (PIBMA), 14 g of a photo-initiator that was 2,2-dimethoxy-2-phenyl acetophenone, and 10 g of a cross-linking agent that was tetramethylolpropane-tetraacrylate were added to 240 ml of 2,2,4-trimethyl-1,3-pentanediol monoisobutyrate and then mixed in an agitator.

The electrode-forming composition manufactured in Experimental Example 3 contained the metal powder and the frit in a weight ratio of 58:10.

COMPARISON EXAMPLE 1

A plasma display panel was manufactured in the same manner as in Experimental Example 1 except that 30 g of frit, which contained $SiO_2$, PbO, $Bi_2O_3$, ZnO, $B_2O_3$, and BaO and wherein the weight ratio of BaO to $B_2O_3$ was 1,650 g of a silver (Ag) powder, 57 g of a binder combining a methyl-methacrylate/methacrylic-acid (MMA/MAA) copolymer, hydroxypropyl cellulose (HPC), ethyl cellulose (EC), and poly(isobutyl methacrylate) (PIBMA), 13 g of a photo-initiator that was 2,2-dimethoxy-2-phenyl acetophenone, and 10 g of a cross-linking agent that was tetramethylolpropane-tetraacrylate were added to 240 ml of 2,2,4-trimethyl-1,3-pentanediol monoisobutyrate and then were mixed in an agitator.

The electrode-forming composition manufactured in Comparison Example 1 contained the metal powder and the frit in a weight ratio of 65:3.

Figure 6:
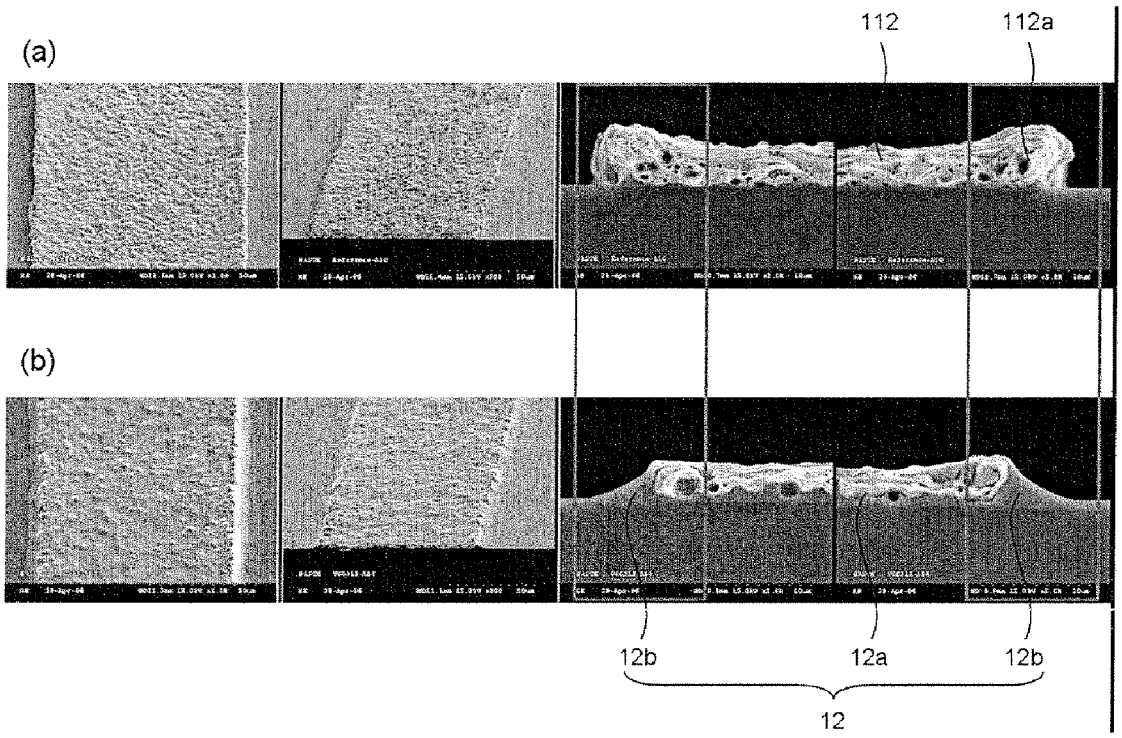
FIG. 6 is an enlarged photograph of a lateral cross-sectional view for comparing an address electrode of Experiment Example 1 and an address electrode of Comparison Example 1.

FIG. 6 is an enlarged photograph of a lateral cross-sectional view for comparing an address electrode of Experimental Example 1 and an address electrode of Comparison Example 1

Referring to FIG. 6, address electrodes 112 and 12 of a plasma display panel manufactured in Experimental Example 1 and Comparison Example 1 were observed by using a scanning microscope. The results thereof are shown in FIG. 6(*b*) and FIG. 6(*a*).

FIG. 6(*b*) is a photograph of the address electrode 12 of Experimental Example 1 viewed by the scanning microscope. FIG. 6(*a*) is a photograph of the address electrode 112 of Comparison Example 1 viewed by the scanning microscope. Referring to FIG. 6(*b*), the address electrode 12 of Experimental Example 1 was adjacent to both edges of the metal layer 12*a*. An insulating glass layer 12*b* was formed on the same plane thereof. On the other hand, referring to FIG. 6(*a*), an edge-curl 112*a* was formed in the address electrode 112 of Comparison Example 1.

Accordingly, an electrode-forming composition of this aspect of the present invention included the metal powder and frit wherein the metal powder and the frit are contained in a weight ratio of 52 to 62:5 to 15. The weight ratio of BaO to $B_2O_3$ contained in the frit was greater than 1. During the process of forming an electrode, the metal powder formed a metal layer by liquid-state sintering in the firing process. An insulating glass layer was formed on the outer surface of the metal layer.

A plasma display panel of this aspect of the present invention includes an electrode in which a glass layer is formed at the edges of a conductive metal layer. Thus, there is an advantage in that a migration effect occurring between adjacent electrodes and an edge-curl occurring at the edges of an electrode can be prevented.

Although the exemplary embodiments and the modified examples of the present invention have been described, the present invention is not limited to the embodiments and examples, but may be modified in various forms without departing from the scope of the appended claims, the detailed description, and the accompanying drawings of the present invention. Therefore, it is natural that such modifications belong to the scope of the present invention.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A plasma display panel comprising:

first and second substrates that face each other with a predetermined distance therebetween;

a first electrode formed on the first substrate and extending in a first direction;

a dielectric layer formed on the first substrate to cover the first electrode;

a second electrode spaced apart from the first electrode, formed on the second substrate, and extending in a second direction crossing the first direction;

a barrier rib defining a plurality of discharge cells in a space between the first substrate and the second substrate; and a phosphor layer formed within each discharge cell, wherein the first electrode contains metal powder and frit in a weight ratio of 52 to 62:5 to 15;

wherein the first electrode includes an insulating glass layer along an edge in the first direction, and wherein the insulating glass layer is formed on each edge of the first electrode, the insulating glass layers being separate from each other; and wherein the first electrode includes a metal layer, and the insulating glass layer is formed in the same plane as the metal layer, and wherein the insulating glass layer is adjacent to the metal layer, and a surface of the insulating glass layer is continuously inclined starting from an edge at the surface of the metal layer to the surface of the first substrate.

2. The electrode-forming composition of claim 1, wherein the frit is selected from the group consisting of $SiO_2$, PbO, $Bi_2O_3$, ZnO, $B_2O_3$, BaO, and combinations thereof.

3. The plasma display panel of claim 2, wherein the frit contains $B_2O_3$ and BaO, and the weight ratio of the BaO to $B_2O_3$ is equal to or greater than 1.

4. The plasma display panel of claim 3, wherein the weight ratio of BaO to $B_2O_3$ is within a range of 1 to 5.

5. The plasma display panel of claim 1, wherein the metal powder is selected from the group consisting of silver (Ag), gold (Au), aluminum (Al), copper (Cu), nickel (Ni), chromium (Cr), zinc(Zn), tin(Sn), an alloy of silver-palladium (Ag—Pd), and combinations thereof.

6. The plasma display panel of claim 5, wherein the metal powder is a silver Ag) powder.

7. A plasma display panel comprising:

first and second substrates that face each other with a predetermined distance therebetween;

a first electrode formed on the first substrate and extending in a first direction;

a dielectric layer formed on the first substrate to cover the first electrode;

a second electrode spaced apart from the first electrode, formed on the second substrate, and extending in a second direction crossing the first direction;

a barrier rib defining a plurality of discharge cells in a space between the first substrate and the second substrate;

a phosphor layer formed within each discharge cell, wherein the first electrode includes an insulating glass layer along an edge in the first direction and wherein the insulating glass layer is formed on each edge of the first electrode, the insulating glass layers being separate from each other; and wherein the first electrode includes a metal layer, and the insulating glass layer is formed in the same plane as the metal layer, and wherein the insulating glass layer is adjacent to the metal layer, and a surface of the insulating glass layer is continuously inclined starting from an edge at the surface of the metal layer to the surface of the first substrate.

8. The plasma display panel of claim 7, wherein the insulating glass layer is formed in a band shape along each edge of the first electrode.

9. The plasma display panel of claim 7, wherein the insulating glass layer is formed to have an inclination so as to be curved.

10. The plasma display panel of claim 7, wherein the first electrode comprises a metal powder and frit, and the metal powder and the frit are contained in the weight ratio of 52 to 62:5 to 15, and wherein the frit is selected from the group consisting of $SiO_2$, PbO, $Bi_2O3$, ZnO, $B_2O_3$, BaO, and combinations thereof.

11. The plasma display panel of claim 10, wherein the frit contains $B_2O_3$ and BaO, and the weight ratio of BaO to $B_2O_3$ is equal to or greater than 1.

12. The plasma display panel of claim 11, wherein the weight ratio of BaO to $B_2O_3$ is within a range of 1 to 5.

13. The plasma display panel of claim 10, wherein the metal powder is selected from the group consisting of silver (Ag), gold (Au), aluminum (Al), copper (Cu), nickel (Ni), chromium (Cr), zinc(Zn), tin(Sn), an alloy of silver-palladium (Ag—Pd), and combinations thereof.

14. The plasma display panel of claim 13, wherein the metal powder is a silver (Ag) powder.

15. The plasma display panel of claim 7, wherein the metal layer is composed of a silver (Ag) powder.

16. The plasma display panel of claim 7, wherein the first electrode includes a metal layer, the metal layer and the insulating glass layer include frit of the same component.

17. The plasma display panel of claim 16, wherein the frit of the metal layer and the frit of the insulating glass layer have the same composition ratio.

18. The plasma display panel of claim 16, wherein the frit is selected from the group consisting of $SiO_2$, PbO, $Bi_2O_3$, ZnO, $B_2O_3$, BaO, and combinations thereof.

19. The plasma display panel of claim 18, wherein the frit of the metal layer and the frit of the insulating glass layer include $B_2O_3$ and BaO, and the weight ratio of BaO to $B_2O_3$ is equal to or greater than 1.

20. The plasma display panel of claim 19, wherein the weight ratio of BaO to $B_2O_3$ is within a range of 1 to 5.

21. The plasma display panel of claim 7, wherein the first electrode is supplied with an address voltage when driven.

22. A plasma display panel comprising:

first and second substrates that face each other with a predetermined distance therebetween;

a plurality of first electrodes formed on the first substrate and extending in a first direction;

a dielectric layer formed on the first substrate to cover the first electrodes;

a plurality of second electrodes spaced apart from the first electrodes, formed on the second substrate, and extending in a second direction crossing the first direction;

a barrier rib defining a plurality of discharge cells in a space between the first substrate and the second substrate; and a phosphor layer formed within each discharge cell, wherein the first electrodes include an insulating glass layer along each edge of each first electrode extending in the first direction, and wherein the thickness of each insulating glass layer in a direction perpendicular to the first substrate decreases with increasing distance from the edge of the corresponding first electrode; and wherein the insulating glass layer is formed on each edge of the first electrode, the insulating glass layers being separate from each other;

wherein the first electrode includes a metal layer, and the insulating glass layer is formed in the same plane as the metal layer, and wherein the insulating glass layer is adjacent to the metal layer, and a surface of the insulating glass layer is continuously inclined starting from an edge at the surface of the metal layer to the surface of the first substrate; and wherein the first electrode is an address electrode.

* * * * *

UNITED STATES PATENT AND TRADEMARK OFFICE

CERTIFICATE OF CORRECTION

PATENT NO. : 8,093,814 B2
APPLICATION NO. : 11/748809
DATED : January 10, 2012
INVENTOR(S) : Chul-Hong Kim and Hyun-Mi Jeong It is certified that error appears in the above-identified patent and that said Letters Patent is hereby corrected as shown below:

Title page (Item 57) Abstract, line 18, Change "lager" to --layer--.

Column 9, line 18, Below "etc.)." insert --Monomer (iii): Other Copolymerizable Monomers--.

Column 11, line 11, After "silver" insert --powder particles constituting the metal layer 12a move freely. The glass frit constituting the--.

Column 13, line 7, Change "1" to --1.--.

Column 14, line 28, In Claim 6, change "Ag)" to --(Ag)--.

Column 14, line 66, In Claim 10, change "$Bi_2O3$," to --$Bi_2O_3$,--.

Signed and Sealed this
Seventh Day of August, 2012

David J. Kappos

David J. Kappos
*Director of the United States Patent and Trademark Office*